US005434350A

United States Patent [19]

Haney et al.

[11] Patent Number: 5,434,350

[45] Date of Patent: Jul. 18, 1995

[54] DRUM AND PERCUSSION SYNTHESIZER

[75] Inventors: David S. Haney, Douglasville; Kimball G. Daniel, Marietta, both of Ga.

[73] Assignee: Zendrum Corporation, Atlanta, Ga.

[21] Appl. No.: 195,150

[22] Filed: Feb. 10, 1994

[51] Int. Cl.[6] ..... G10H 3/00; G10H 1/32

[52] U.S. Cl. ..... 84/743; 84/730

[58] Field of Search ..... 84/644, 670, 730, 737, 84/743–745, DIG. 12, DIG. 24

[56] References Cited

U.S. PATENT DOCUMENTS 4,418,598 12/1983 Klynas .
4,867,028 9/1989 Jones ..... 84/735
5,223,655 6/1993 Watanabe et al. ..... 84/637

*Primary Examiner*—William M. Shoop, Jr.
*Assistant Examiner*—Jeffrey W. Donels
*Attorney, Agent, or Firm*—Jones & Askew

[57] ABSTRACT

A percussion synthesizer comprising a generally triangular body with a triangular upper surface upon which a plurality of piezoelectric transducers are mounted. Side surfaces adjacent the top surface and intersecting same at angles between 180 and 270 degrees also carry transducers. The outputs from the transducers are provided to a MIDI interface that transmits standard musical instrument digital interface data to a sound reproduction device. The identity of the transducer provides the pitch information for the MIDI interface and the velocity is calculated from the time rate of change of the output voltage from the piezoelectric transducers.

An improved transducer having superior cross talk suppression capabilities is also disclosed.

18 Claims, 7 Drawing Sheets

DRUM AND PERCUSSION SYNTHESIZER

TECHNICAL FIELD

The present invention is in the field of electronic musical instruments and in particular is an improved drum and percussion synthesizer playable by a free standing musician that includes an improved trigger transducer.

BACKGROUND OF THE INVENTION

Since the middle part of the 20th century, many traditional mechanical/acoustical instruments have spawned electronic substitutes in the form of electronic instruments that mimic some of the tonal characteristics of their mechanical/acoustic forebearers. Electronic instruments were originally designed in response to a need for less expensive and more portable versions of their traditional counterparts. For example, the electric organ was one of the first relatively popular musical instruments. Early electric organs were relatively complex and expensive pieces of equipment with mechanically rotating tone wheels and speaker cabinets with rotating horn structures within them. Later, electric pianos became popular with performers of various types of popular music because of their relatively light weight and resultant portability.

Naturally, the fundamental instrument of rock and roll and modern rock music for 40 years has been the electric guitar. The electric guitar became a fundamental instrument of various forms of popular music in large part because of the sound colorations and intensity levels that could be reached playing an electric guitar rather than increased portability with respect to its acoustic counterpart.

Since the 1970s when the microprocessor was first introduced, the capabilities of digital electronic devices to process numbers and signals has been increasing at a rate that nearly doubles every two to three years. This, coupled with increased density of integrated circuit technology, has led to electronic devices that can reproduce, process, and alter very complex wave forms to produce sounds that not only mimic traditional mechanical acoustic instruments but have their own range of coloration that was unimaginable 20 years before.

Today, virtually any musical instrument can be mimicked to a significant degree by an electronic counterpart that includes appropriate signal generating and wave shaping circuitry. Today, not only electronic devices designed specifically to be music synthesizers play high quality multi-part music, but many small computers have significant musical capabilities included as standard, or relatively inexpensive add on equipment.

In response to the need for a standard notation for the electronic reproduction of sound and to provide portability of compositions and arrangements among various electronic music producing devices, a standard interface with a standard protocol has been created. This is known as the Musical Instrument Digital Interface, commonly referred as the MIDI standard. The MIDI standard is well documented and familiar to those skilled in the art. It is a serial interface standard that specifies a five pin connector with a 220 ohm output impedance. Serial data is transmitted at 31.25 kilobits per second and it provides 16 distinct channels for 16 distinct voices. The standard addresses encoding of pitch and velocity data for each channel. A wide variety of modern electronic musical instruments accept input from the performer and encode the required sounds in response to this input in the form of standard MIDI output. This outpout can be delivered MIDI synthesizing device that will thus produce a sound of the intended pitch, intensity, and tone quality.

The invention is the subject of this specification was designed principally to be used in the genre of popular music normally referred to as rock music. However, those familiar with popular music forms know that characterizations by genre are only useful for providing a relatively general sense of the nature and quality of the music in question. Thus, while the present invention is not limited to use in popular music performances, this specification adopts the terminology popular music in its broader sense of distinguishing from what is normally referred to as "classical" music. As such, it includes rock, rock and roll, jazz and a wealth of other genres and sub-genres that have been named and performed over the years.

The invention that is the subject of this specification is an improved drum and percussion synthesizer. It has been known for some period of time that planar piezoelectric transducers make good trigger transducers for percussion synthesizers because they produce, when struck, a voltage output that approximates the impulse like sound pressure characteristics output from acoustic percussion instruments. Earlier drum synthesizers included several discrete piezoelectric transducers mounted on some form of shock absorbing backing. The outputs of the transducers were connected to some form of wave shaping and amplification signal to produce different drum sounds. It is known in the art to selectively attach the piezoelectric trigger transducers to various positions on a pad using hook and eye material such as that sold under the trademark Velcro ® to selectively position the pads and to provide some shock absorption and isolation.

The inventors of the present invention have discovered that the most common drawback in prior art pad-type drum synthesizers is cross talk among the trigger transducers. By the very nature of the apparatus, the striking of one trigger transducer tends to impart a pressure impulse to adjacent transducers, thus leading to false triggering of drum sounds other than the one intended by striking a particular transducer.

Furthermore, much popular music is performed at very high sound pressure levels. This creates a situation in which there is significant acoustic feedback that can excite piezoelectric trigger transducers.

More recent prior art synthesizers include a device known as the Buchla Thunder. This is a membrane keyboard device that includes some keys having multiple segments and pressure and velocity sensitive membrane switches. The outputs in the membrane switches are connected to an interface for generating MIDI output and the apparatus has the possibility of controlling all 16 MIDI channels simultaneously. The thunder device is usable as a percussion synthesizer as well as a synthesizer of a variety of other sounds. The arrangement of the pads is essentially a trapezoidal pattern with the various key areas slanted to match the slopes of the non-parallel sides of the trapezoid.

As any aficionado of popular music knows, many popular musicians like freedom of movement on stage when performing. Dancing, gyrations, and other animated motions are an integral part of the performance of many popular musicians. Players of keyboard and percussion instruments have typically, in the past, been confined to the locations of their instruments and have not had the freedom of movement that, for example, singers, guitar and bass players have enjoyed. To date, there has been no provision of a percussion and drum synthesizer specifically designed to allow it to be played by an experienced percussionist while freely moving about in a standing position.

Furthermore, prior art devices used for drum synthesizers have generally required either striking a trigger transducer with a stick, in a manner that mimics the playing of acoustic drums, or have been relegated to keyboard type devices such as the Buchla Thunder apparatus discussed above. While it is a versatile transducer for providing MIDI standard output, the Buchla Thunder is essentially a keyboard device, even though the keys can be programmed to produce percussion sounds. Such a keyboard device does not provide a percussionist with an opportunity to play drum parts using hand motions that are familiar and comfortable to players of certain acoustic percussion instruments played with the hands. It is known that many percussionists like to play a hand part using rapid oscillating rotations of the hand about the axis of the bones of the forearm so that the thumb and fingers move up and down in a rapid manner. Some of the fingers can reach other parts of the drum head to change the tone produced by striking it. This type of motion often feels natural to percussionists and allows a rapid repetition rate for percussion sounds. Therefore, there is a need in the art for a drum and percussion synthesizer that allows an experienced percussionist to play familiar drum parts using familiar and natural feeling motions of the hands and fingers.

Lastly, an instrument that combines the two desirable qualities described above, i.e., operability from a standing position and playing by natural motions, also benefits from improved isolation of the trigger transducers used to trigger various percussive sounds.

SUMMARY OF THE INVENTION

The present invention provides an instrument with all three of the above described desirable characteristics. It is an ergonomically designed synthesizer device particularly designed for (but not limited to) allowing the player to suspend it from a strap over his or her shoulder and play it while in a free standing position. The most fundamental aspect of the present invention is the provision of three interconnected surfaces, one being a top surface and two side surfaces that intersect the top surface at angles greater than 180 but less than 270 degrees. Preferably, the two side surfaces have adjoining edges that intersect each other at an angle of greater than 90 degrees. A plurality of trigger transducers are disposed on these three surfaces, and each trigger transducer is connected to a percussion synthesizing device, preferably embodied by a MIDI encoder, for producing a particular percussive sound.

In its preferred form, a set of basic percussion instrument sounds, including a bass drum, a snare drum and two or more cymbal sounds are each produced by multiple transducers on the different surfaces. It is the selection and distribution of the duplication of triggers for particular percussion sounds that provides some of the improved ergonomic aspects and natural playability of the synthesizer of the present invention. Among the preferred aspects of the trigger transducer distribution is the placement of plural bass drum triggers on the top surface and at least one bass drum trigger on one of the side surfaces. Another aspect is the location of at least two snare drum triggers along the same one of the side surfaces, which triggers are separated by at least two triggers that produce a specific cymbal sound. This provides a way of doing snare drum rolls interspersed with cymbal sounds using three or four fingers of the player. It is also preferred to have at least one additional snare transducer on the top surface.

The shape of the preferred form of the present invention provides access to the triggers via a plurality of hand positions where in the fingers and thumbs of the player can be rapidly manipulated in a way that does not exert undue stress on the joints of the wrists and elbows.

The improved transducer of the present invention is constructed with a rigid support member that includes a cap and side wall element. It is preferably round so that the cap is circular and the side wall element forms a cylinder.

A conventional wafer piezoelectric element mounted in an annular ring is urged up against the cap in the interior of the side wall element. This is followed by an O-ring that seats against the bottom side of the annular ring holding the piezoelectric element, and the balance of the volume is filled with a resilient support member, preferably embodied by a button of neoprene foam.

Some apparatus for attaching the neoprene foam to the surface carrying the transducer on the body of the instrument is provided. In the preferred embodiment, the attaching apparatus is embodied by conventional hook and eye material such as that sold under the trademark Velcro®. In the preferred embodiment of the present invention, the trigger positions are indicated by wells sunk in the top and side surfaces that carry the transducers. It is preferred to have the combination of the depth of such well, the thickness of the hook and eye for other material for holding the transducer on the surface and a portion of the resilient support member that extends below the side wall sized so that the lower edge of the side wall does not contact the surface of the instrument during normal playing. In other words, the thickness of the materials supporting the transducer structure and securing it to the top and side surfaces should be such that the lower edge of the side wall is held above the body surface to which the transducer is attached. This means that only the resilient support member (preferably constructed of neoprene foam) and the attachment apparatus (preferably hook and eye material) serves as a mechanical coupling mechanism among the transducers.

Testing of these transducers by the inventors has indicated that they have superior cross talk characteristics with respect to prior art percussion synthesizer transducers with which the inventors are familiar.

It is therefore an object of the present invention to provide an improved percussion synthesizer device that is ergonomically designed to be played by an experienced percussionist in a free standing position, preferably while strapped to the player's body in a manner similar to an electric guitar or electric bass.

It is a further object of the present invention to provide such an instrument that may be played using natural and non-stressful hand and finger motions for a percussion player.

It is still a further object of the present invention to provide a percussion synthesizer with an improved trigger device, which trigger device has superior cross talk suppression characteristics over the prior art.

It is a further object of the present invention to provide an improved percussion and drum synthesizer wherein trigger transducers are distributed on a plurality of surfaces and members of a predetermined set of drum sounds are produced by multiple transducers that are spaced apart in a manner to allow convenient playing of combinations of percussion sounds in various hand positions.

It is a further object of the present invention to provide a percussion synthesizer device that allows the percussion player the same freedom of movement to participate in non-sound producing aspects of a popular music performance to the same degree that performers playing other instruments, such as guitars and electric basses, have enjoyed in the past.

That the present invention accomplishes these objects, and overcomes some of the drawbacks of the prior art will be appreciated from the detailed description of the preferred embodiment to follow.

DETAILED DESCRIPTION OF THE PREFERRED EMBODIMENT

Figure 1:
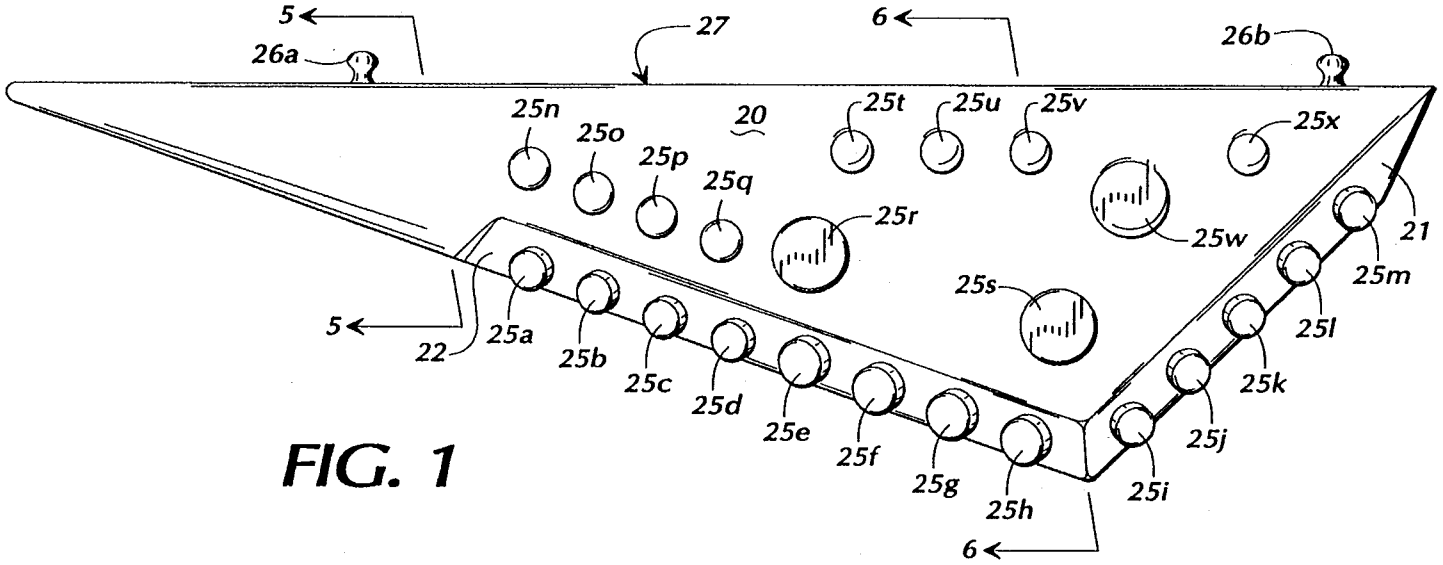
FIG. 1 is a top plan view of the preferred embodiment of the present invention.

Turning next to the drawing figures in which like numerals represent like parts, the preferred embodiment of the present invention and certain aspects of the playing of same will now be described.

FIG. 1 shows a top plan view of the preferred embodiment of the present invention. As may be seen in the drawing figure, the preferred embodiment is generally triangular in shape. It includes a top surface 20, first side surface 21 and second side surface 22 upon which a plurality of transducers **25*a*–25*x* are mounted. Transducers 25*a*–25*h* are mounted on second side surface 22. Transducers 25*i*–25*m* are on first side surface 21, and transducers 25*n*–25*x* are on top surface 20. As can be seen from inspection of FIG. 1, transducers 25*e*–25*h*, 25*r*, 25*s*, and 25*w* are larger than the balance of the transducers. In the preferred form of the present invention, the size differences are used only as a visual and tactile aid to the player. They do not substantively affect the performance of the instrument, nor are such size differences required to embody the present invention. The construction of the transducers and the musical significance of the respective ones shown in FIG. 1** will be described in detail hereinbelow.

A back side 27 carries two binding posts **26*a* and 26*b*** that are used to secure the ends of a shoulder strap to the preferred embodiment. These are conventional posts such as are used on electric guitars and the like. This allows the player of the instrument to attach a strap that goes over his or her shoulder leaving the instrument in place in front of the player, while suspended from the strap.

Figure 2:
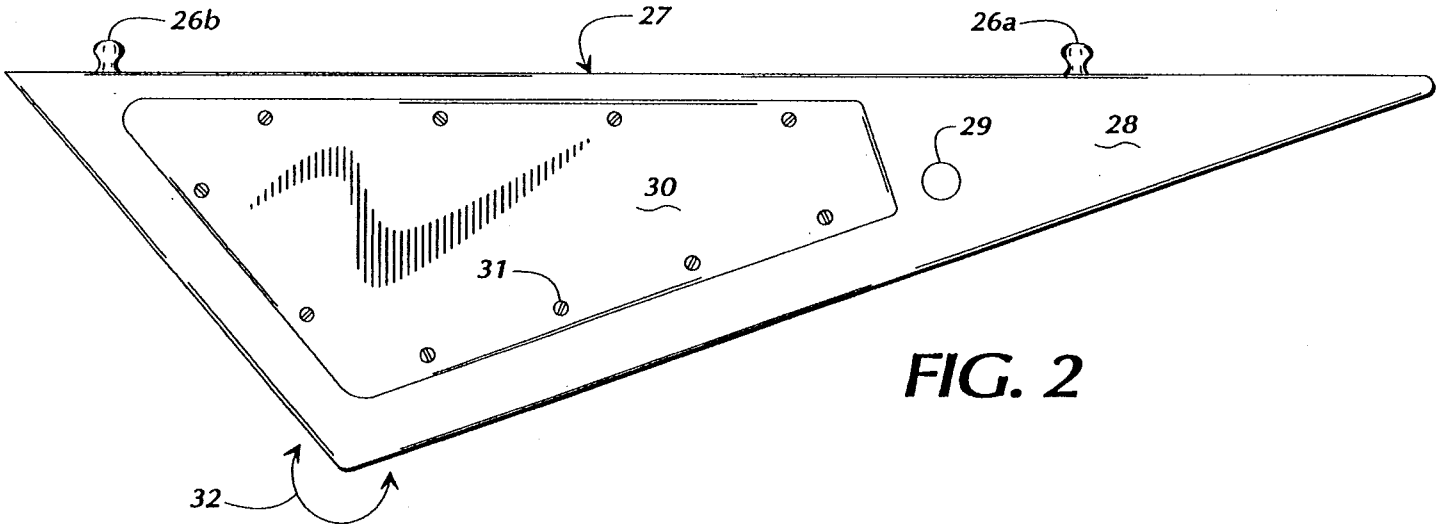
FIG. 2 is a bottom plan view of the preferred embodiment of the present invention.

Turning next to FIG. 2, a bottom plan view is shown. A bottom surface 28 carries a five pin Cannon plug that provides output to a MIDI sound generator. A removable panel 30 is shown that is held in place by a plurality of screws, a typical one of which is indicated at 31. This panel provides access to the interior of the instrument where the MIDI interface circuit board is located.

The angle between the lower edges of first and second side surfaces 21 and 22 is indicated at 32 in FIG. 2. It is preferred that this angle be in excess of 90 degrees, for reasons that will be appreciated when the playing of the instrument is described further hereinbelow.

Figure 3:
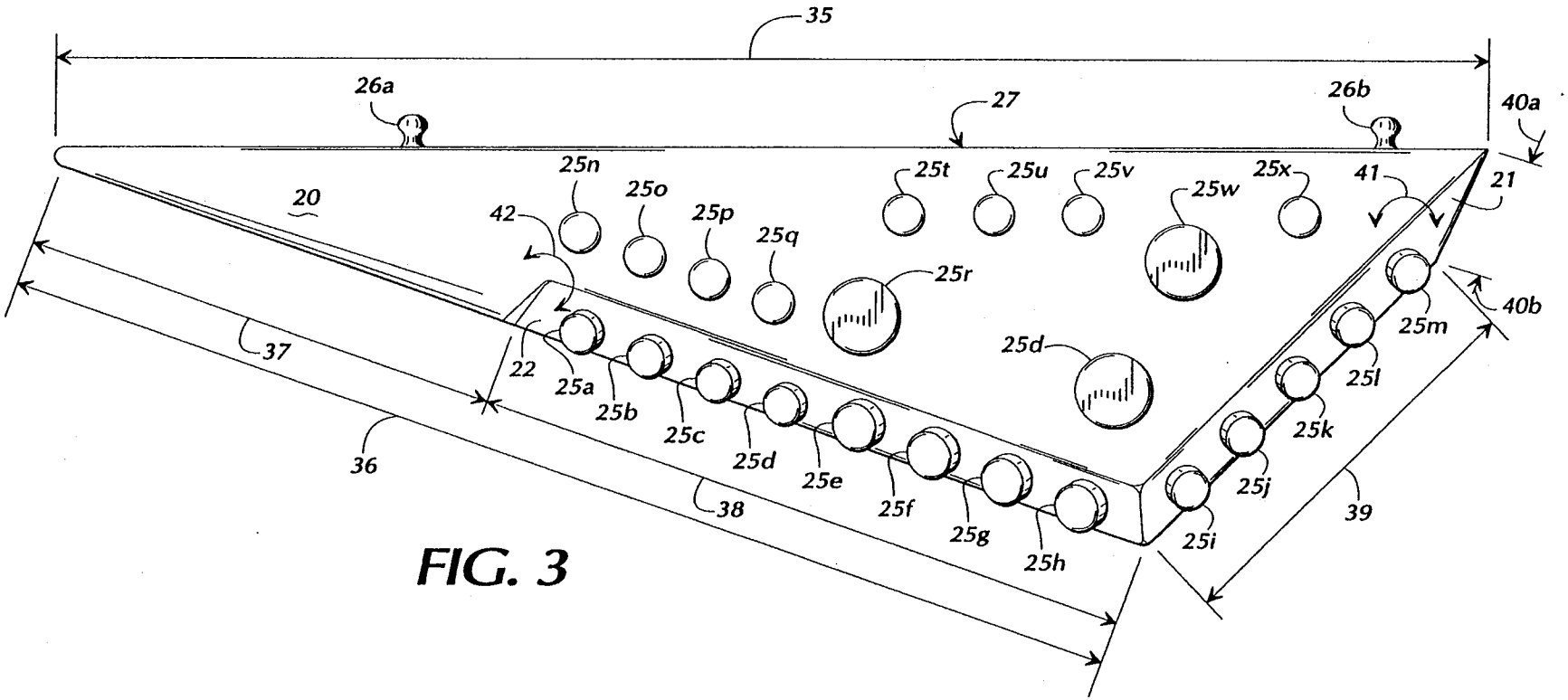
FIG. 3 is another top plan view of the preferred embodiment of the present invention.

While size is not, per se, a limitation on practice of the present invention, FIG. 3 is provided to indicate the dimensions of the preferred embodiment for the purposes of describing what the inventors believe to be the best mode of practice in the invention as of the writing of this specification. In FIG. 3, dimension lines 35–40 are shown. In the preferred embodiment, dimension line 35 designates that side 27 is 37½ inches long. Dimension line 36 is 30 inches, which may be subdivided into a 13½ inch dimension line 37 and 16½ inch dimension line 38. The length of the lower edge of first side surface 21 is indicated by dimension line 39, and is 8 inches in the preferred embodiment. The corner height designated by dimension line **40*a* and 40*b*** is four inches in the preferred embodiment.

One aspect of the preferred embodiment that facilitates the ease of play is the angular relationship between top surface 20 and side surfaces 21 and 22. The angles therebetween are represented respectively at 41 and 42 in FIG. 3. The preferred embodiment is preferably played in hand positions that include both reaching over the top of the instrument and ones that include wrapping the left hand of the player around from the back of the instrument so that the fingers can contact the trigger transducers on side surfaces 21 and 22. It is therefore important that the transducers on these surfaces be reachable from either the top side or the bottom side of the instrument. In the preferred embodiment, both angles 41 and 42 are equal to 235 degrees. It is considered important that the angle between the top surface and the respective side surfaces be greater than 180 degrees and less than or equal to 270 degrees. This allows the side surface transducers to be reached either from the top or bottom side and played without putting undue stress on the joints of the player.

Figure 4:
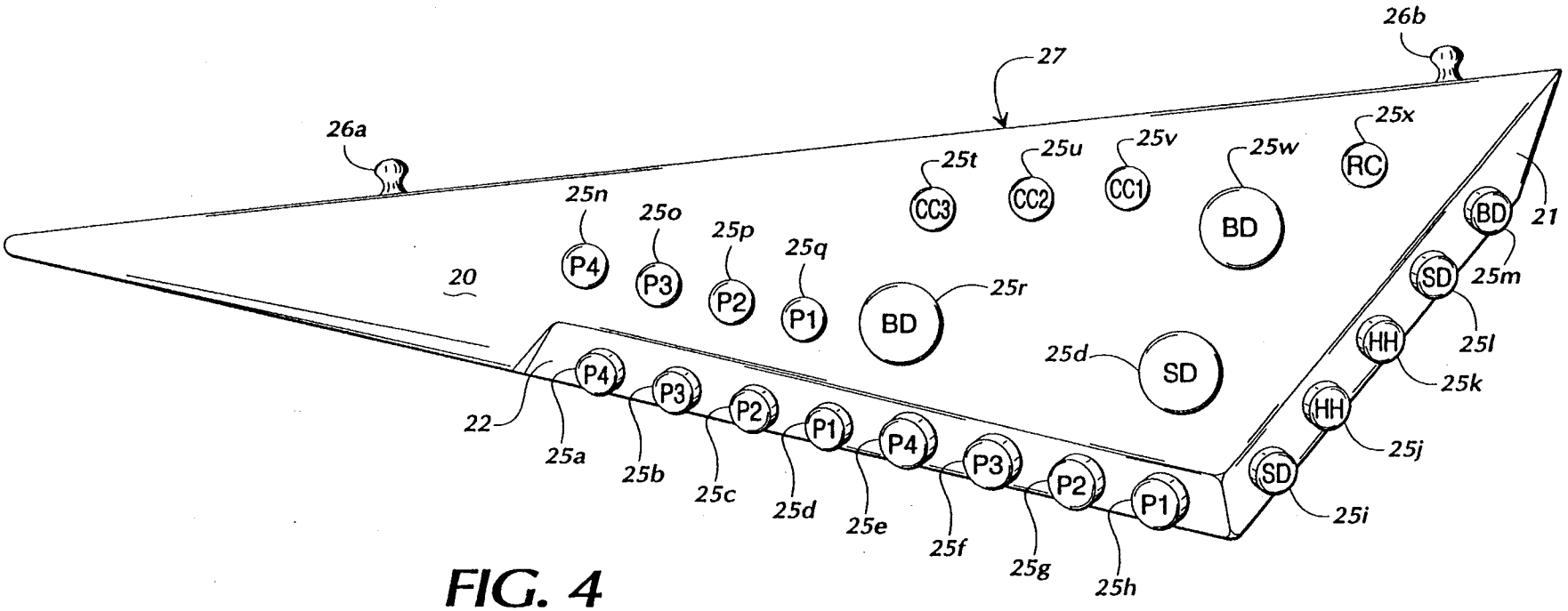
FIG. 4 is a top plan view of the preferred embodiment of the present invention showing the preferred arrangement of trigger transducers by sound produced.

FIG. 4 shows transducers **25*a*–25*x* labeled by their preferred arrangement of the percussion sounds they produce. As noted above, the present invention connects each of the triggers to a particular input of a MIDI sound generator that is associated with a particular percussion sound. Thus the wires connecting transducers 25** to a percussion sound synthesizer are connected so that each of the transducers activates the synthesizer, i.e., the MIDI controller, to produce a particular one of a set of predetermined percussion sounds. In the preferred embodiment, the set of sounds includes at least a bass drum sound, a snare drum sound, a plurality of cymbal sounds and a plurality of miscellaneous percussion sounds. Miscellaneous percussion sounds include virtually any other percussive sound that is or can be used in a musical context. Examples include other drums such as tom-toms, timbales and cow bells, maracas, castanets. There is a virtually limitless list of tonal qualities that can be used as miscellaneous percussion.

An important aspect of the present invention is how certain of the trigger transducers associated with particular percussion sounds are arranged and distributed on surfaces 20–22. These are important because they provide for playing the synthesizer using various hand positions. It also provides an opportunity for the player to progressively familiarize himself or herself with the capabilities of the synthesizer by providing most of the sounds of a basic drum trap in a relatively simple hand position and then allowing the player to explore the other possibilities by branching out to activate other transducers once basic playing has been mastered.

In FIG. 4, each of the transducers 25 is labeled with a two or three character designator that indicates the sound produced when that particular trigger is activated. The code for these designators is shown in the following Table 1.

TABLE 1

| Character Label | Sound Produced |
|---|---|
| BD | Bass Drum |
| SD | Snare Drum |
| RC | Ride Cymbal |
| CC1 | Crash Cymbal 1 |
| CC2 | Crash Cymbal 2 |
| CC3 | Crash Cymbal 3 |
| HH | High Hat |
| P1 | Miscellaneous Percussion Sound 1 |
| P2 | Miscellaneous Percussion Sound 2 |
| P3 | Miscellaneous Percussion Sound 3 |
| P4 | Miscellaneous Percussion Sound 4 |

Among the important aspects of the arrangement are that at least one bass drum transducer, either 25*r* or 25*w*, appears on top surface 20, and a second trigger for activating the bass drum sound appears on first side surface 21 as transducer 25*m*. This arrangement allows the player to activate the bass drum sound from several different hand positions using several different digits.

Likewise, snare drum transducers appear as both transducer 25*s* on top surface 20 and transducers 25*i* and 251 on first side surface 21. Another important aspect is the provision of two snare drum triggers (21*i* and 251) on side surface 21 that are spaced apart and separated by a pair of cymbal transducers, in this case the high hat transducers 25*j* and 25*k*. This allows the snare drum sound to be rapidly activated by striking transducers 25*i* and 251 with index and forefinger and using the intervening two fingers to produce the high hat sound by striking transducers 25*j* and 25*k*. From consideration of the tonal significance of the sounds produced by activation of the trigger transducers and the playing of the instrument using the hand positions described hereinbelow, the versatility of the instrument and its intuitive appeal to the experienced drummer will be appreciated by those familiar with the art of playing percussion instruments.

Figure 5:
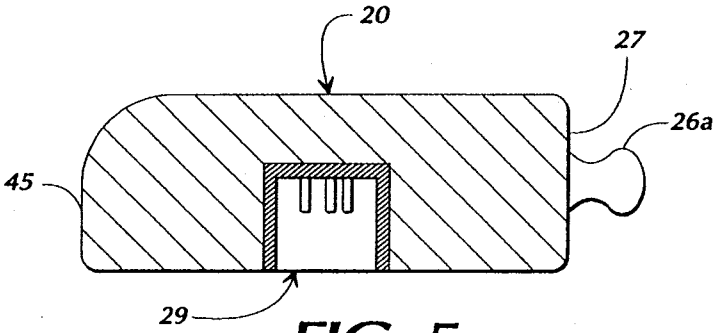
FIG. 5 is a cross section of the preferred embodiment taken along section line 5—5 in FIG. 1.

FIG. 5 shows a section taken along line 5—5 indicated in FIG. 1. Turning for a moment to FIG. 2, it should be understood that section line 5—5 in FIG. 1 passes through Cannon plug connector 29 that is visible in FIG. 2. It is also shown in FIG. 5. This plug provides standard MIDI output to be provided to a MIDI based sound synthesizer. It can also be seen that as one proceeds along the lower side of the preferred embodiment to the left, as viewed in FIG. 1, that after side surface 22 terminates the balance of the body is fitted with a side 45 that is parallel to side 27.

Figure 6:
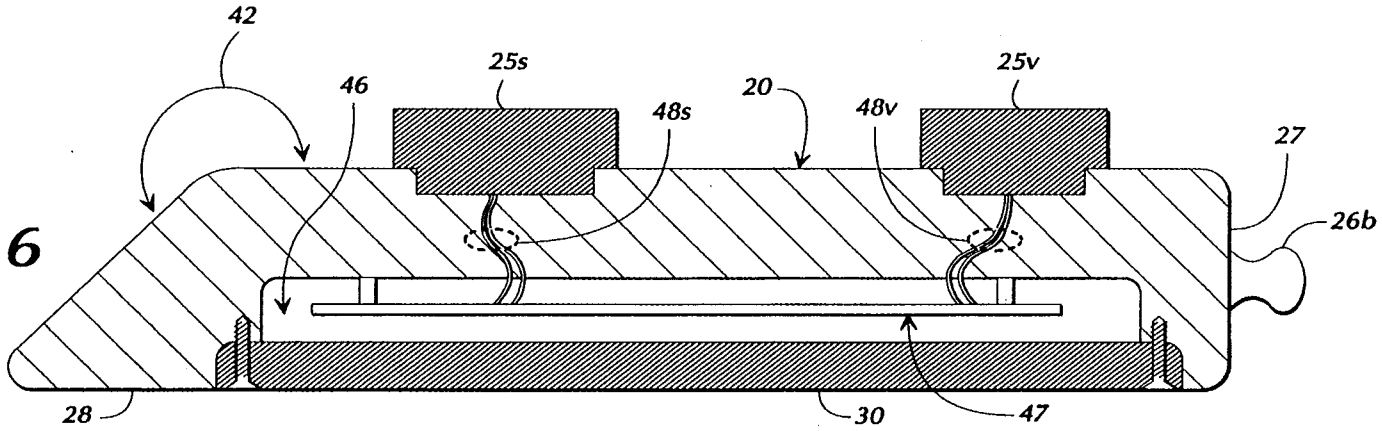
FIG. 6 is a cross section of the preferred embodiment taken along section line 6—6 in FIG. 1.

FIG. 6 shows a section taken along line 6—6 in FIG. 1. It should be understood that transducers 25*s* and 25*v* are shown generally in cross section without the details that are discussed in connection with the description of the improved transducer that follows hereinbelow. A cavity, indicated at 46 is formed within the interior of the preferred embodiment. A circuit board 47 that carries the MIDI interface is mounted therein. From each of transducers 25*s* and 25*v*, a pair of wires, 48*s* and 48*v*, respectively, are passed and connected to circuit board 47. It should be understood that the other transducers shown in the various drawing figures have similar wire pairs that are connected to circuit board 47 and form a connecting means for connecting the plurality of trigger transducers 25 to a percussion synthesizer that comprises the MIDI interface on circuit board 47 so that each of the transducers activates the percussion synthesizer to produce a particular one of a set of predetermined percussion sounds described above. Access to the circuit board 47 and cavity 46 is provided by selective removal of panel 30.

Figure 7:
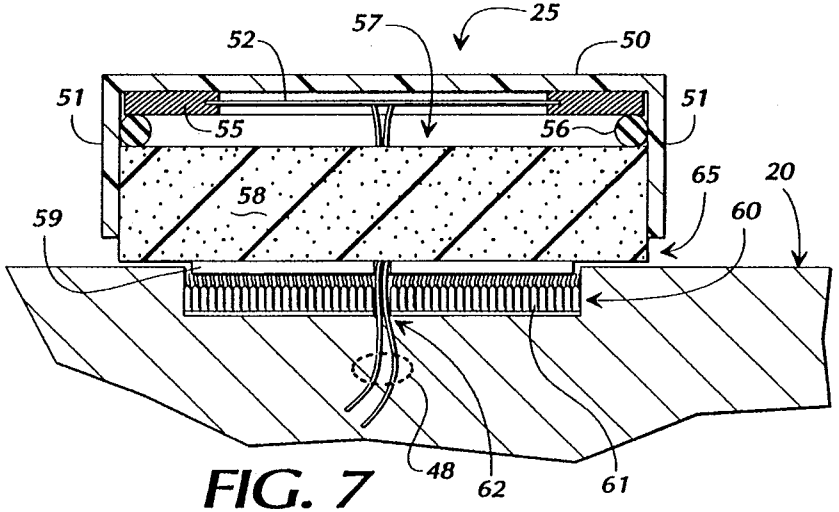
FIG. 7 is a cross section of the preferred embodiment of the improved transducer of the present invention.

From the foregoing, the mechanical and physical arrangement of the preferred embodiment will be fully appreciated. Next, the improved trigger transducer employed in the preferred embodiment of the present invention will be described. A typical exemplary transducer 25 is shown in cross section in FIG. 7. The transducers are covered by a rigid support member that comprises a cap 50 and side wall element 51. Since, in the preferred embodiment, the transducer support members are round, side wall element 51 is cylindrical and cap 50 is circular. However, this is not a limitation on the shape that can be used for trigger transducers in embodiments of the present invention. In the preferred embodiment the rigid support member is formed by unitary construction of cap 50 and side wall element 51, as shown in FIG. 7. The piezoelectric transducer 52 is conventional in nature and mounted to an annular ring 55 made of dense cardboard, bakelite or similar supporting material. Such piezoelectric transducers are well known to those skilled in the art and are available, for example, from Radio Shack stores operated by Tandy Corporation in the United States.

Annular ring 55 is held in place by an O-ring 56 that keeps annular ring 55 urged up against cap 50. This provides an air space, indicated at 57 below piezoelectric transducer 52 in the volume surrounded by O-ring 56.

A resilient support member 58 is preferably embodied by a slug of neoprene foam. This is cut and sized so as to fit very snugly within the interior of side wall element 51 so that the neoprene foam resilient support member will stay in place and keep O-ring 56 seated against annular ring 55.

A disk of the hook element 59 of hook and eye fastening material is glued to the bottom of neoprene resilient support member 58. A well, indicated at 60, is formed in top surface 20 at each transducer location. In the bottom of the well, a corresponding disk of eye material, indicated at 61, is glued in place. A hole 62 passes through the bottom of well 60 through which wire pair 48 from piezoelectric transducer 52 extends. It should be noted that the resilient support member 58 is sized so that there is a gap between the bottom of side wall element 51 and surface 20, as indicated at 65 in FIG. 7. This prevents the rigid support member from striking surface 20 when it is hit to be activated during playing of the instrument.

The inventors of the present invention believe that the combination of resilient support member 58 and hook and eye material 59, 61 are principally responsible for the improved isolation and thus, improved cross talk characteristics of the transducer shown in 57. Furthermore, it is believed that employment of O-ring 56 assists in reducing the response of piezoelectric member 52 to external acoustic stimuli that are transmitted through cap 50 and side wall element 51. It is further believed that the air space 57 that is provided by O-ring 56 assist in improving the sharpness of the velocity characteristics that are obtained by the preferred embodiment of this improved transducer.

Figure 8:
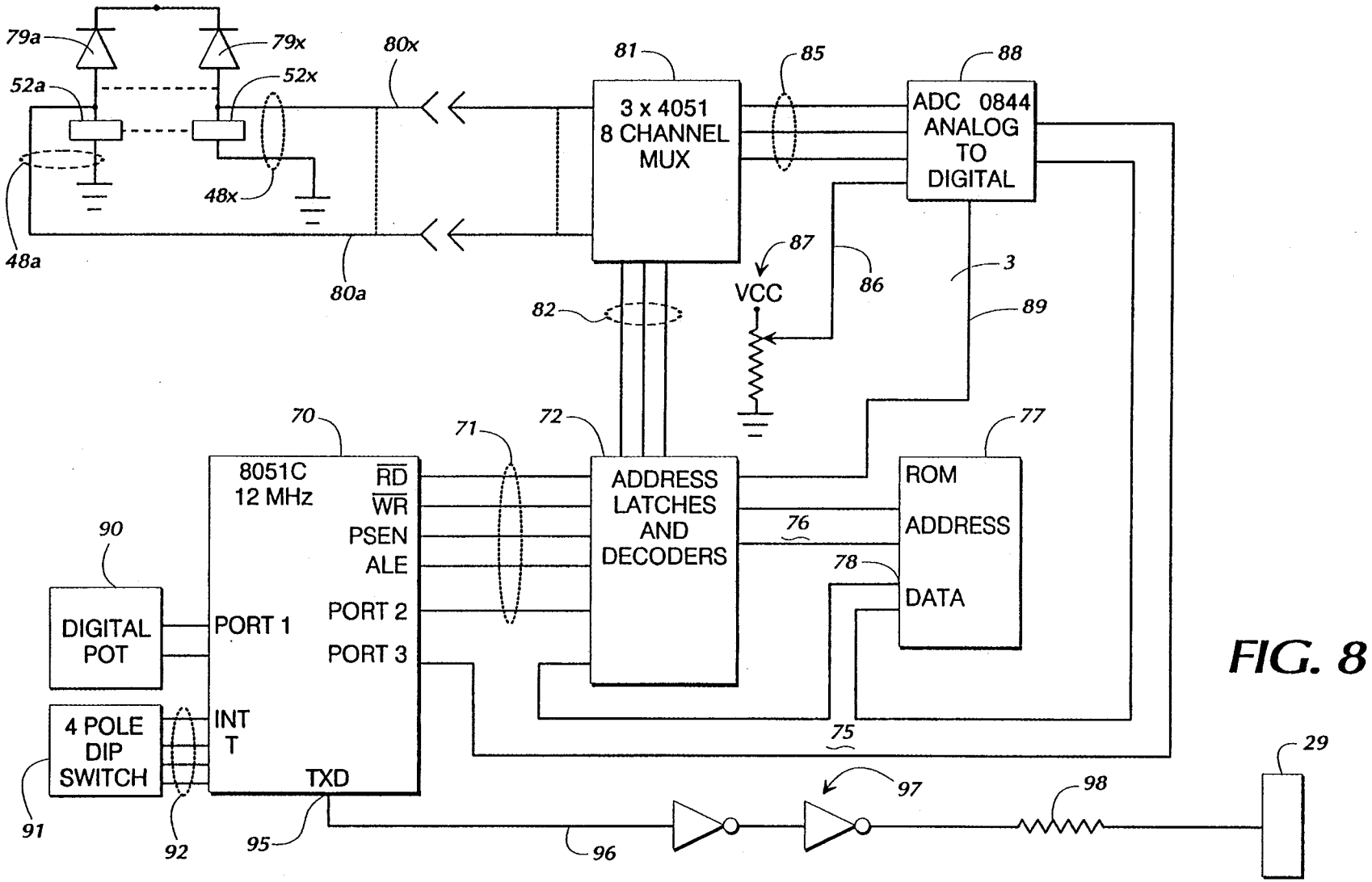
FIG. 8 is a block diagram of the MIDI interface circuitry employed in the preferred embodiment.

Turning next to FIG. 8, the MIDI interface of the preferred embodiment is shown. The MIDI interface shown in FIG. 8 is described in this specification for purposes of describing the best mode of the invention known to the inventors at the time of writing this specification. It is not believed that the MIDI interface is, per se, inventive and, indeed, is not the work of the present inventors. It has been designed as an economical implementation of a MIDI interface particularly suitable for a single MIDI channel triggering device such as the preferred embodiment.

The MIDI controller is built around a 12 megahertz version of the popular 8051C CMOS one chip microcomputer, shown as 70 in FIG. 8. Such a device and the programming of same is well known to those skilled in the art of designing embedded microprocessor and microcomputer controlled devices. The standard set of address control lines, shown as 71, is provided to a set of address latches and decoders 72. The data lines and address lines from microcomputer 70 emanate from ports 2 and 3 of this device, and manifest themselves as bus 75 that is also connected to address latches and decoders 72.

The fully latched and decoded address bus 76 is provided to the address inputs of read only memory 77, which stores the control instructions for implementing the MIDI interface. Data bus 75 is connected to the data inputs 78 of ROM 77. The signals from the transducers are provided as follows. Piezoelectric elements **52*a* and 52*x* are shown in FIG. 8. The dashed lines therebetween indicate that the remaining 22 piezoelectric elements of the transducers are duplicated. The piezoelectric elements are connected via reverse biased diodes 79*a*–79*x*** that provide bias voltage for the piezoelectric elements.

Wire pairs **48*a*–48*x* are connected so that one member of the pair is grounded and the other is provided on one of input lines 80*a*–80*x* as one of the 24 inputs to an array of three 4051 eight channel multiplexers, indicated at 81 in the drawing figure. These multiplexers are addressed by three low order address lines, collectively shown as 82, coming from the address latches and decoders 72. In the preferred embodiment, the input channels to multiplexers 81 are scanned at a rate of about 10 kilohertz. The three output lines from the multiplexers are shown collectively as 85 and provide input to three of the four channels of a type ADC0844 analog-to-digital converter, currently made by National Semiconductor Products. The fourth channel is connected to line 86, which in turn is connected to the wiper of potentiometer 87 that is used to set a noise threshold for the instrument. Potentiometer 87 is adjusted so that it provides a voltage on line 86, and this voltage is treated by microcomputer 70** as being the minimum voltage that must be present in order to generate an output. This threshold is particularly useful for suppressing acoustic feedback.

Three control lines indicated collectively as 89 control channel selection and the reading of output from A-to-D converter 88. The digitized output is read onto data bus 75 in a conventional manner. Therefore, during operation the player strikes transducers 25 (FIG. 1) which causes one of piezoelectric elements 52 to generate an output on one of lines 80. This output is picked up as the lines are scanned by multiplexer bank 81 at a 10 kilohertz rate and samples of the voltage output from the piezoelectrics are stored in registers within microcomputer 70. The microcomputer keeps track of the state of each of the 24 input channels from the transducers. When a rising wave form is detected, the value of the most recent sample is stored and this continues until the value starts to go down. When this happens, the highest reading obtained is used to provide a velocity output in appropriate MIDI format.

Pitch information that is transmitted from the MIDI interface to an externally connected MIDI sound synthesizer is determined by the particular channel, i.e., particular one of lines **80*a*–80*x***, upon which the signal appears. In other words, the pitch information is determined by the particular transducer that has been activated. This translates to the particular percussion sound produced by each transducer.

Port 1 of microcomputer 70 is connected to a digital potentiometer 90 that simply as a volume control. A four pole dual in line packaged switch 91 has outputs shown as 92 that are connected to the interrupt and timer input pins of microcomputer 70. These may be read by the microcomputer. The four pole switch establishes a one-of-16 code, and is used to select the particular one of the 16 MIDI channels in which output from the preferred embodiment will appear.

As is known to those skilled in the art of microprocessor circuit design, the 8051 includes an internal universal asynchronous receiver transmitter (UART) and the internal UART is used to provide the serial MIDI output. The transmit data output from the device's internal UART appears as the TDX output 95 that is connected to line 96. A pair of inverters shown as 97 buffer the output and sharpen the edges. A 220 ohm load resistor 98 is provided per the MIDI specification, and the output therefrom is provided to one pin of the Cannon connector 29. Naturally, other MIDI interface devices can be used in constructing embodiments of the present invention.

Since the MIDI controller has a separate physical channel into MUX array 81 from each of the trigger transducers 25, it will be apparent to those skilled in the art that it is possible to alter the tonal significance of the trigger transducers so that each of the triggers produces a distinct sound. Thus, it is considered within the scope of the present invention to provide a structure having the functional equivalents of top surface 20 and side surfaces 21 and 22, each with a plurality of trigger transducers disposed thereon, for which the assignment of particular sound output for each trigger is left to the user. The geometry of the synthesizer of the present invention allows for versatile playability. The arrangement with duplicated triggers is preferable in the view of the inventors of the present invention, but should not obscure the underlying basic invention or the opportunity to expand the repertoire of sounds at the cost of requiring more agility in the playing of the instrument.

FIGS. 9–14 show basic hand positions that are used by a player of the preferred embodiment. These figures are produced without reference numerals so as to keep them uncluttered. Reference to each of the figures in conjunction with FIG. 4, which indicates the tonal significance of each of the transducers of the preferred embodiment, will assist in understanding the playing of the instrument.

Figure 9:
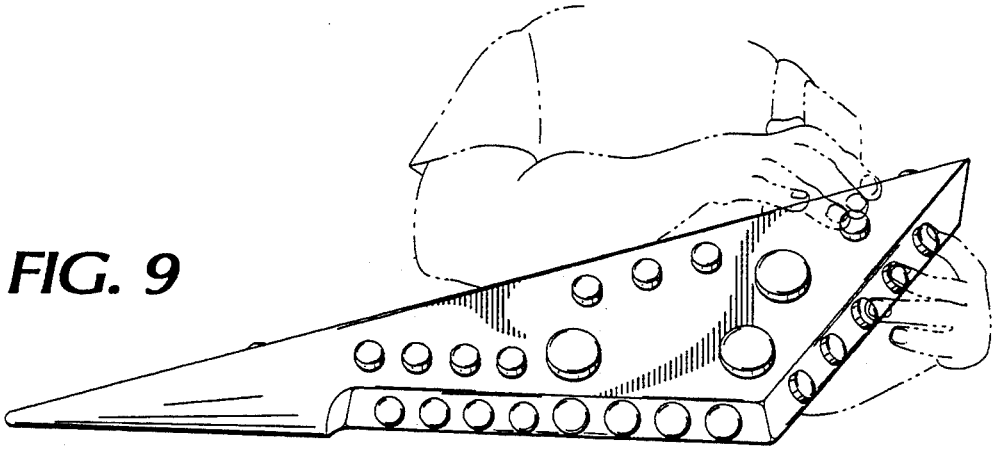
FIGS. 9–14 each show a specific hand position for playing the preferred embodiment of the present invention.

FIG. 9 shows one of the basic hand positions for playing the sounds from a conventional drum trap. The first three fingers of the player's left hand strike transducers 25*m*, 251, and 25*k* on first side surface 21. Three fingers of the right hand rest on top surface 20 and the small finger thereof is used to strike transducer 25*x*. From inspection of this drawing and FIG. 4, it will be appreciated that the bass drum, snare drum and high hat can be activated by the left hand with the ride cymbal (transducer 25*x*) and another bass drum transducer (25*w*) can be activated by the right hand. This position gives the player access to the basic sounds of a drum trap. If any of the crash cymbal transducers 251–25*v* need to be activated, the player's right hand is momentarily moved to strike one of these transducers and then returns to the position proximate ride cymbal transducer 25*x*.

Figure 10:
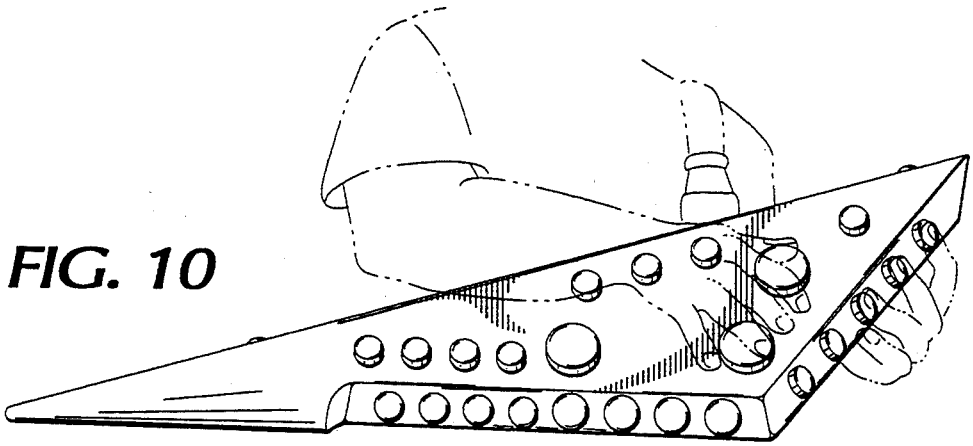

FIG. 10 shows a second hand position in which the left hand is essentially in the same position as it is in FIG. 10. In this position, the top surface bass and snare drum transducers 25*w* and 25*s*, respectively, are activated by the thumb and fourth finger of the right hand. This provides the possibility of very rapid repetition rates on the snare drum and bass drum since transducer pairs for each of these sounds may be struck in a rapid alternating manner by fingers on different hands.

Figure 11:
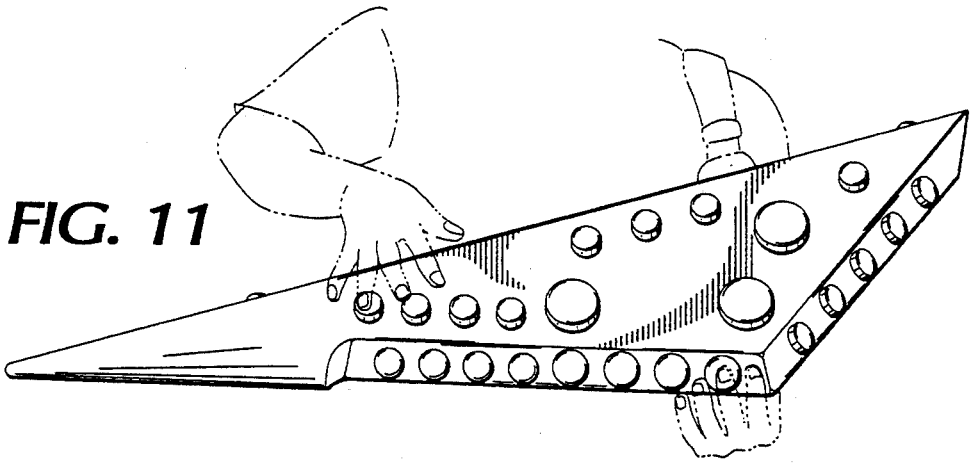

FIG. 11 shows a position in which the miscellaneous percussion sounds are being played on both hands. The player's left hand has been moved around to the second side surface 22 and is positioned to activate the four miscellaneous percussion transducers that comprise the set 25*e*–25*h*. The right hand is positioned to activate duplicate transducers for those sounds (25*n*–25*q*) on top surface 20 and the player's thumb can also reach bass drum transducer 25*r*.

Figure 12:
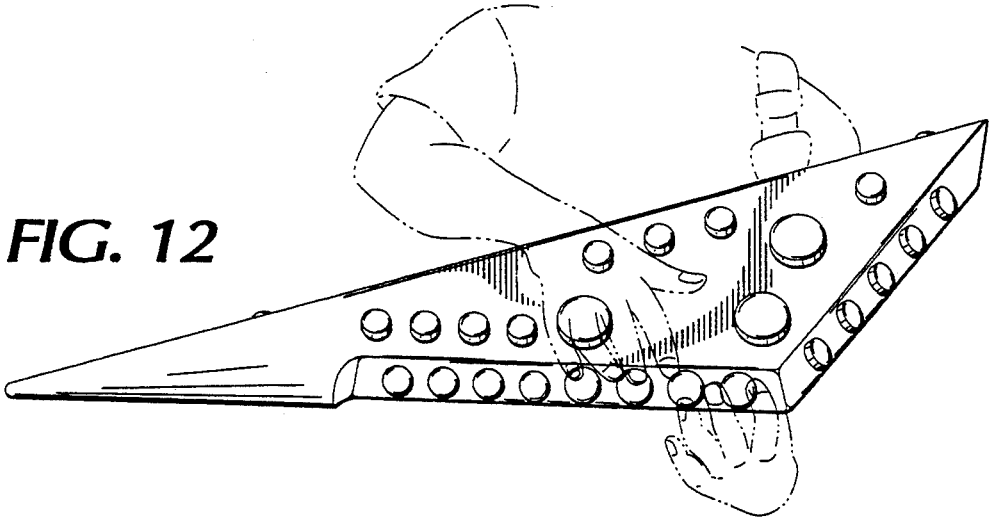

FIG. 12 shows a modification of the FIG. 11 position in which the left hand remains positioned to play the miscellaneous percussion sounds on transducers 25*e*–25*h* and the right hand has been moved so that it may assist in playing those transducers as well as have the thumb strike the snare drum transducer 25*s* and be moved momentarily to strike the transducers 25*t*–25*v* for the various crash cymbal sounds.

Figure 13:
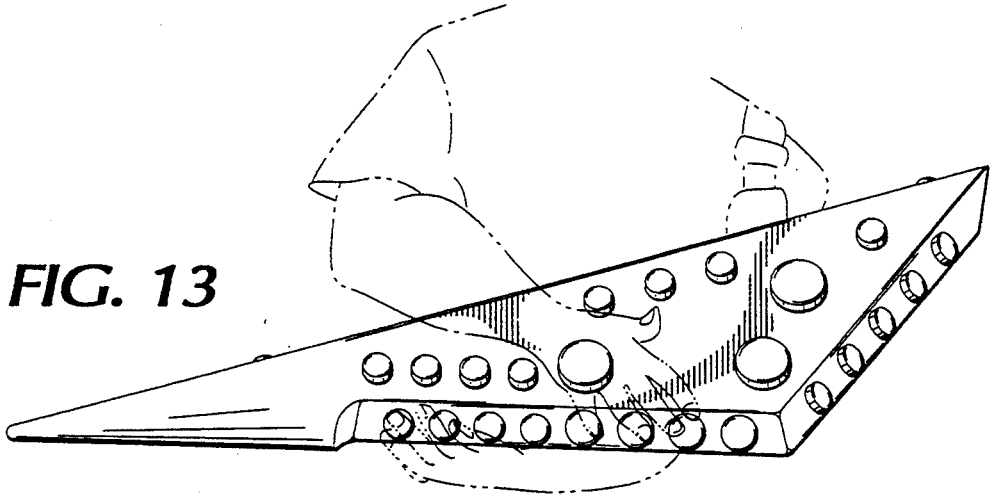

In FIG. 13, the left hand has been moved to engage a second set of miscellaneous percussion transducers 25*a*–25*d* on second side surface 22. The right in this position can selectively activate the other miscellaneous percussion transducers on surface 22. The heel of the right hand is used to strike bass drum transducer 25*r* while the thumb can be momentarily moved to activate crash cymbal transducers 25*t*–25*v*.

Figure 14:
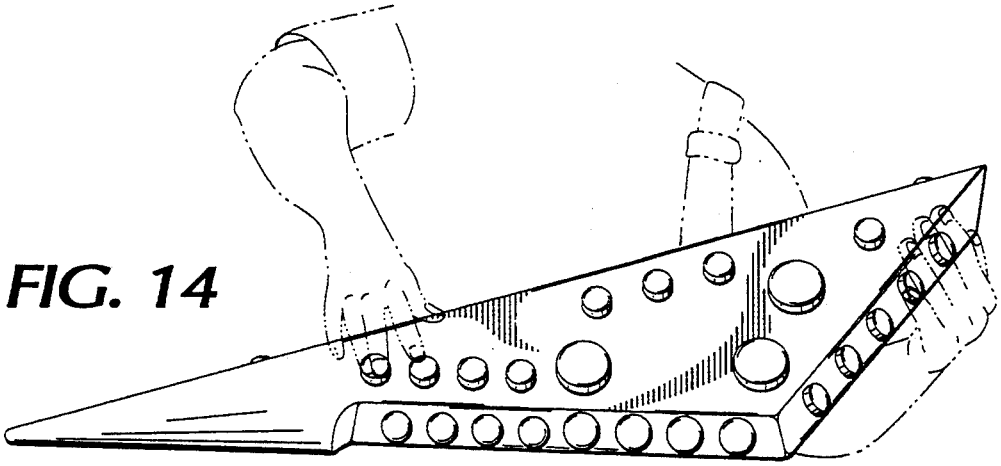

FIG. 14 shows another position in which the left had plays three elements of the basic drum trap, i.e., bass drum, snare drum and high hat and the right hand is positioned to play the miscellaneous percussion parts.

The foregoing description of hand positions will be understood by those skilled in the arts of instrument design and playing instruments to be a basic set of typical hand positions for playing relatively common sequences of percussion sounds. As with any musical instrument, the more it is played, the more agile and quick the player should become. The versatility of sound sequences that can be produced using the instrument of the preferred embodiment will increase accordingly. Thus, the hand positions should not be taken as limitations, but examples of how the ergonomic design allows versatile use of a synthesizer according to the present invention.

From the foregoing description of the preferred embodiment and methods of using it, it will be appreciated that the present invention fulfills the above described need from the prior art and accomplishes the above recited objects of the invention. It should further be understood that the preferred embodiment disclosed herein is only the preferred form and is not, per se, limiting of the scope of the present invention. For example, successful implementations of the present invention may be made with transducers of conventional quality, rather than those of the improved variety described herein. Furthermore, there is a relatively wide range of geometric shapes that embodiments of the present invention can take that still provide the relative spacing and accessibility need to construct a practical embodiment of the present invention. Therefore, the scope of the present invention should be limited only by the claims below and equivalents thereof.

What is claimed is:

1. A drum synthesizer comprising in combination:

a body having at least a top surface and first and second side surfaces, each of said side surfaces intersecting said top surface at an angle greater than 180 degrees and less than 270 degrees;

a plurality of trigger transducers disposed on said top surface and said first and second side surfaces;

connection means for connecting said plurality of trigger transducers to a percussion synthesizer so that each of said trigger transducers activates said percussion synthesizer to produce a particular one of a set of predetermined percussion sounds, said set of sounds including at least a bass drum sound, a snare drum sound, a plurality of cymbal sounds, and a plurality of miscellaneous percussion sounds;

wherein said connection means connects said plurality of trigger transducers to said percussion synthesizer so that at least a first two of said transducers on said top side produce said bass drum sound and said first two transducers are spaced apart by intervening transducers that produce at least some of said plurality of cymbal sounds and at least a second two of said transducers on said first side produce said snare drum sound and said second two transducers are spaced apart by intervening transducers that produce at least some of said plurality of cymbal sounds.

2. A drum synthesizer as recited in claim 1 wherein: all of said plurality of trigger transducers that are disposed on said second side surface are connected to said percussion synthesizer to produce particular ones of said plurality of miscellaneous percussion sounds.

3. A drum synthesizer as recited in claim 1 wherein said top surface is triangular.

4. A drum synthesizer as recited in claim 1 wherein said top surface is in the shape of an obtuse triangle having a shortest side adjoining said first side surface.

5. A drum synthesizer comprising in combination:

a body having at least a top surface and two side surfaces, each of said side surfaces intersecting said top surface at an angle greater than 180 degrees and less than 270 degrees;

a plurality of trigger transducers disposed on said top surface and said two side surfaces;

connection means for connecting said plurality of trigger transducers to a percussion synthesizer so that each of said trigger transducers activates said percussion synthesizer to produce a particular one of a set of predetermined percussion sounds, said set of sounds including at least a bass drum sound, a snare drum sound, and at least one cymbal sound;

wherein said connection means connects said plurality of trigger transducers to said percussion synthesizer so that both a first one of said transducers on said upper surface and a second one of said transducers on one of said two side surfaces produces said bass drum sound and both a third one of said transducers on said upper surface and a fourth one of said transducers on one of said two side surfaces produces said snare drum sound.

6. A drum synthesizer as recited in claim 5 wherein said plurality of trigger transducers disposed on said top surface and said two side surfaces are held in place by hook and eye fastening material.

7. A drum synthesizer as recited in claim 5 wherein said top surface is triangular.

8. A drum synthesizer as recited in claim 5 wherein said top surface is in the shape of an obtuse triangle.

9. A drum synthesizer comprising in combination:

a body having a top surface and at least one side surface, said side surface intersecting said top surface at an angle greater than 180 degrees and less than 270 degrees;

a plurality of trigger transducers disposed on said top surface and said side surface;

connection means for connecting said plurality of trigger transducers to a percussion synthesizer so that each of said trigger transducers activates said percussion synthesizer to produce a particular one of a set of predetermined percussion sounds, said set of sounds including at least a bass drum sound, a snare drum sound, and at least one cymbal sound;

wherein said connection means connects said plurality of trigger transducers to said percussion synthesizer so that both a first one of said transducers on said upper surface and a second one of said transducers on said side surface produces said bass drum sound and both a third one of said transducers on said upper surface and a fourth one of said transducers on said side surface produces said snare drum sound.

10. A drum synthesizer as recited in claim 9 wherein said side surface is a first side surface, and further comprising a second side surface, said second side surface intersecting said top surface at an angle greater than 180 degrees and less than 270 degrees;

a portion of said plurality of trigger transducers being disposed on said second side surface;

wherein said connection means connects said plurality of trigger transducers to said percussion synthesizer so that all of said portion of said plurality of trigger transducers disposed on said second side surface all activate said percussion synthesizer to produce a sound that is not a member of said set of predetermined percussion sounds.

11. A drum synthesizer as recited in claim 9 wherein said plurality of trigger transducers disposed on said top surface and said side surface are held in place by hook and eye fastening material.

12. A drum synthesizer as recited in claim 9 wherein said top surface is triangular.

13. A drum synthesizer as recited in claim 9 wherein said top surface is in the shape of an obtuse triangle having a shortest side adjoining said side surface.

14. A drum synthesizer comprising in combination:

a body having at least a top surface and two side surfaces, each of said side surfaces intersecting said top surface at an angle greater than 180 degrees and less than 270 degrees;

a plurality of trigger transducers disposed on said top surface and said two side surfaces; and connection means for connecting said plurality of trigger transducers to a percussion synthesizer so that each of said trigger transducers activates said percussion synthesizer to produce a particular one of a set of predetermined percussion sounds, said set of sounds including at least a bass drum sound, a snare drum sound, and at least one cymbal sound.

15. A drum synthesizer comprising in combination:

a body having at least a top surface and two side surfaces, each of said side surfaces intersecting said top surface at an angle greater than 180 degrees and less than 270 degrees;

a plurality of trigger transducers disposed on said top surface and said two side surfaces;

connection means for connecting said plurality of trigger transducers to a musical sound synthesizer so that each of said trigger transducers activates said synthesizer to produce a particular one of a set of predetermined musical sounds.

16. A drum synthesizer as recited in claim 15 wherein said plurality of trigger transducers disposed on said top surface and said two side surfaces are held in place by hook and eye fastening material.

17. A drum synthesizer as recited in claim 15 wherein said top surface is triangular.

18. A drum synthesizer as recited in claim 15 wherein said top surface is in the shape of an obtuse triangle.

* * * * *